United States Patent [19]

Iten et al.

[11] 4,325,392

[45] Apr. 20, 1982

[54] FACIAL BRUSH FOR CONTROLLING *PSEUDOFOLLICULITIS BARBAE*

[75] Inventors: Clemens A. Iten, Staunton, Va.; David O. Chase, Skaneateles, N.Y.

[73] Assignee: American Safety Razor Company, Verona, Va.

[21] Appl. No.: 45,469

[22] Filed: Jun. 4, 1979

[51] Int. Cl.[3] ..... A45D 27/22

[52] U.S. Cl. ..... 132/80 R; 132/85; 15/159 A; 15/187; 15/DIG. 5; D4/19

[58] Field of Search ..... 132/9, 11 R, 83 R, 83 A, 132/83 B, 83 C, 83 D, 83 E, 83 F, 83 G, 83 H, 85, 120, 80 R, 80 A, 80 B; 119/85, 86; D4/2, 13, 14, 19, 20, 27; D28/28, 33; 128/355, 357; 15/159 A, 160, 186, 187, 188, DIG. 5

[56] References Cited

U.S. PATENT DOCUMENTS

| | | | |
|---|---|---|---|
| 1,870,756 | 8/1932 | Seykora | D4/19 X |
| 2,426,328 | 8/1947 | Wandel et al. | 15/159 A |
| 2,516,491 | 7/1950 | Swastek | 15/188 |
| 3,182,808 | 5/1965 | Benoit et al. | 15/187 X |

*Primary Examiner*—Charles N. Hart
*Assistant Examiner*—David R. Sadowski
*Attorney, Agent, or Firm*—Wender, Murase & White

[57] ABSTRACT

A brush having bristles of varying heights in predetermined configurations is disclosed for extirpating ingrown facial hair from false follicles prior to shaving. The brush includes bristles of specified shapes, and incorporates a support for a razor. By properly preparing ingrown hairs for shaving a condition known as *pseudofolliculitis barbae* is more easily managed, thus alleviating physical and social discomfort.

10 Claims, 7 Drawing Figures

FACIAL BRUSH FOR CONTROLLING *PSEUDOFOLLICULITIS BARBAE*

BACKGROUND OF THE INVENTION

1. Field of the Invention

The present invention relates to facial massage brushes, and more particularly to brushes utilizing bristles having varying heights for dislocating ingrown hairs. More specifically still, the present invention pertains to a facial massage brush for use in conjunction with a razor and containing support means for retaining such a razor.

2. Prior Art

No prior art is known for dealing with problems associated with a condition known as razor bumps, or pseudofolliculitis barbae (hereinafter PFB).

Facial massaging brushes for use during shaving are known. Such brushes are illustrated by Grove, U.S. Pat. No. 1,801,196; Seykora, U.S. Pat. No. 1,870,756 and Sohn, U.S. Pat. No. 1,188,214. These brushes, however, in providing massaging bristles of uniform height, fail to provide any alleviation for razor bumps, a condition afflicting large numbers of men having curly facial hair.

Other prior teachings of brushes, illustrated by Lussier, et al., U.S. Pat. No. 3,146,484; Andreoli, U.S. Pat. No. 2,603,211 and Swastek, U.S. Pat. No. 2,516,491 disclose scalp massage and shampooing brushes, generally circular in origin which, while having central bristle-free portions, cannot therein support razors. Moreover, such brushes do not provide varying bristle length in an optimal distribution useful for alleviation of PFB. Thus, while Swastek includes central cone-shaped fingers extending beyond the ends of large, less resilient fingers at the periphery of the massaging apparatus therein, such fingers are not flexible and excessively hard for facial usage. Moreover, lack of flexibility evidenced by the structure of the fingers shown therein does not provide means for slipping under ingrown hairs. While a brush having alternating rows of short and long bristles for providing gentle brisk scrubbing action is shown in Kaufman, U.S. Pat. No. 3,556,667, such a brush does not provide varying bristle heights useful in removal of ingrown hairs at varying pressures of application or other advantageous features usable in conditioning ingrown hairs for shaving.

Additional disclosures of brushes are known, including Okazaki, U.S. Pat. No. 4,014,064 and Spydevold, U.S. Pat. No. 3,727,260 (pertaining to hair brushes having particular length bristles); Giesecke, U.S. Pat. No. 502,513 (multi-height tufts in a horse brush); Thompson, U.S. Pat. No. 926,303 (a crowned face massaging implement having bristles of a uniform length); Sterrick, U.S. Pat. No. 1,458,371 (uniform bristled massage brush and shaving brush combination); Richardson, U.S. Pat. No. 3,315,296 (a dust brush with inclined long bristles at its periphery); Kaye, et al., U.S. Pat. No. 2,865,039; Schad, U.S. Pat. No. 3,128,488; Snodderly, U.S. Pat. No. 3,309,727; Sampson, U.S. Pat. No. 904,650 and Lasater, U.S. Pat. No. 2,206,726.

A cap manufactured by Imperial Plastics and used on K2R aerosol cans includes a plurality of concentric rings of bristles. The innermost four rings, for example, all appear to be long, and the outermost three rings seem to be of successively shorter bristle heights. The concentration of apparently equal height long bristles minimizes effectiveness of such a brush in providing bristles for slipping under ingrown hairs and dislodging the same with the aid of shorter, stiffer, bristles interspersed with the longer bristles.

None of the above references disclose an apparatus for combating the effects of razor bumps, particularly in combination with caddying means for an associated razor.

The present invention accordingly overcomes the difficulties of the prior art and provides a brush useful for the preparation of ingrown hairs for shaving, thus at least partially alleviating the condition called razor bumps.

SUMMARY OF THE INVENTION

In providing a brush useful in alleviation of the symptoms of pseudofolliculitis barbae, the present invention provides an integrally molded brush, preferably formed of injection molded plastic such as polyethylene or polypropylene.

The inventive brush is structured always to have some active bristles, regardless of the applied pressure, and to adapt to different facial shaving areas. For example, the brush is useful at convex areas, such as a chin, and concave areas, as the shaving area under the jawbone.

The brush includes a structure having a plurality of concentric rows of bristles, the bristles including a relatively uniform distribution of long bristles and a plurality of shorter bristles having varying, predetermined heights.

The present brush more specifically provides for alternating rows of long and shorter bristles, the annular rows of shorter bristles having progressively greater heights approaching the center of the massage brush.

An additional feature of the invention is the combination of a means for curling underneath a hair loop with means for nudging hair, illustratively, formed by the longer more flexible bristles and the shorter, stiffer bristles, respectively.

The present invention additionally provides a storage location for a razor handle, for convenient storage of the combination handle and brush when not in use.

Still another feature of the present invention is the provision of a plurality of drain holes at the base of the brush, particularly around the periphery thereof. An additional feature of the invention provides a drain hole in the central cup provided for storage of the razor handle.

An additional feature of the invention is the stepped nature of the base of the brush for added rigidity. Along with the stepped structure, the base is dished in order to minimize an "oil-can" effect when pressure is applied thereto, as well as to promote drainage through the peripheral drain holes.

The base is provided with a knurled edge to facilitate gripping of the present massage brush.

Yet another advantage of the present invention is the raised location of the bottom wall of the central storage cup with respect to the rim wall surrounding the base of the brush, thereby assuring stability of the pedestal formed by the rim when used for storage of the razor handle. Such elevation, moreover, avoids blockages of the drain hole for the central cup portion.

These and other objects, features, and advantages of the present invention will become more readily apparent from the following specification and appended claims, when considered in conjunction with the attached drawings.

DETAILED DESCRIPTION OF THE PREFERRED EMBODIMENT

Figure 1A:
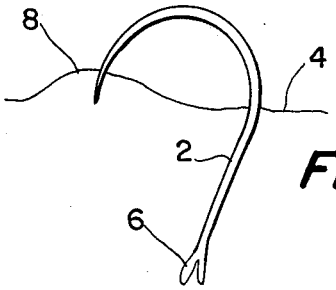
FIG. 1*a* illustrates an ingrown hair, emerging from a follicle and penetrating the skin a short distance away.

Black men who shave are known to suffer from an extremely common cutaneous affliction known as pseudofolliculitis barbae. See, for example, Strauss and Kligman, *Pseudofolliculitis of the Beard*, Arch. Derm., Vol. 74, pages 533–542, 1956. As illustrated in Fig. 1*a*, the condition arises as a result of a curved hair 2 emerging through skin surface 4 from a follicle 6 at an acute angle and continuing to curve in its external path. Continued curvature in growth leads to skin penetration a few millimeters away from the point of emergence of the hair. Such intrusion produces various papules, pustules, or small nodules at the point of penetration, in a typical inflammatory reaction to skin penetration by a foreign body. Such a papule is shown at 8 in FIG. 1*a*. While more severe reactions may occur, the above enumerated symptoms are commonly called razor bumps.

A common approach to the problem of razor bumps is abstinence from shaving (Strauss et al., supra). The positive result of abstinence is due to withdrawal of the hair shafts from the "false follicles" as the beard grows. Healing of the affected skin is promoted thereby. However, resumption of shaving leads to a recurrence of the initial condition in fairly short order.

Figure 1B:
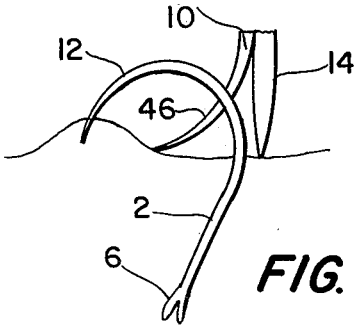
FIG. 1*b* illustrates the use of a brush of the present invention to withdraw the ingrown hair of FIG. 1*a*.

The present invention provides a brush with bristles of differing lengths thereby permitting a long bristle, shown at 10 in FIG. 1*b*, to flex upon application of pressure to the brush contacting the skin. The flexed bristle will slip under a loop 12 of an ingrown hair, tending to dislodge the same. A rubbing action of the brush presents a shorter and stiffer bristle 14 at the hair providing further agitation and rubbing action in withdrawing the same.

It is possible that a full loop as shown in FIG. 1*b* may not form. That is, the ingrown hair may be partially or wholly subcutaneous. In that event a flexed long bristle 10 will not dislodge the same, but the scrubbing action of the more rigid bristle 14 may be used at least partially to remove the skin and expose the hair.

Referring now to FIGS. 2 through 5, the inventive brush is shown generally at 20.

Figure 4:
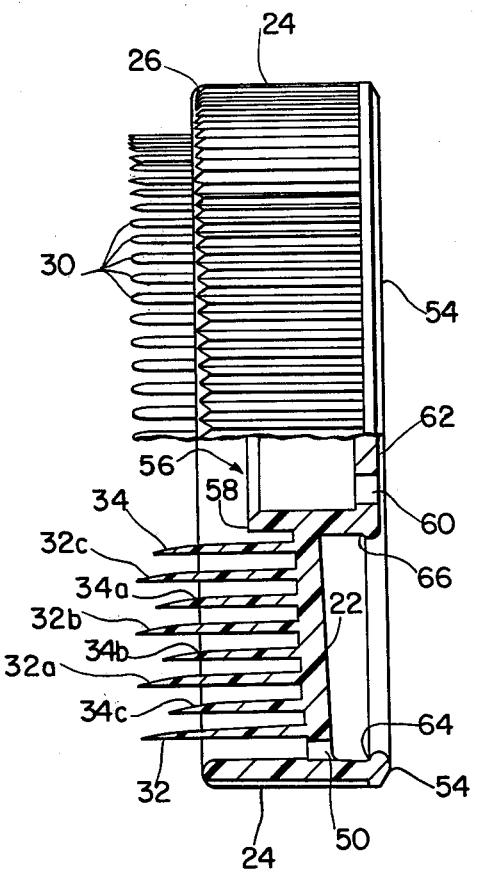
FIG. 4 is an elevation view, partially in cross-section, taken along line 4—4 in FIG. 3.

The brush is formed of a generally horizontal base member 22 surrounded by a substantially vertical sidewall portion 24. The sidewall along the periphery of the base member provides a peripheral side support means for the brush. As shown in FIG. 4, vertical portion 24 is formed with a plurality of vertical molded indented lines 26. While a circular base member 22 and brush is preferred, other shapes may be utilized for the inventive brush.

Utilization of lines 26 effectively knurls sidewall 24 and permits easy manipulation and grasping of the brush by means of the sidewall. Knurling however, may be omitted from the brush without departing from the scope of the present invention. Alternatively, the knurled lines 26 may take different orientations from the vertical direction shown in FIG. 4.

A plurality of bristles is formed integrally with base and sidewall members 22 and 24, preferably in concentric, annular rows 28. As is apparent from FIG. 2, the bristles are formed on the base portion with varying orientations. Specifically, it is seen that the apices of different bristles may point in different directions.

As seen most clearly in FIG. 4, individual bristles 30 extend in a substantially vertical direction from base member 22.

As is also seen in FIG. 4, the preferred embodiment of the present invention provides for alternating annular rows of long and short bristles, the outer annular row of bristles being illustratively shown as a long row 32, and the innermost annular row being shown as a short row 34. It is also noted that rows 32*a*, 32*b* and 32*c* are all composed of bristles having the same height, particularly the height of the bristles in row 32. Rows 34*a*, 34*b* and 34*c*, however, are now shown as comprising bristles all having the same height. In fact, row 34*a* is shown as being comprised of bristles shorter than those in row 34. Row 34*b* is shorter than 34*a* and row 34*c* is shorter still than 34*b*. While the exact arrangement of the increasing or decreasing row height for the short rows 34 may be varied, it is advantageous to have rows of varying height for reasons outlined below.

Figure 2:
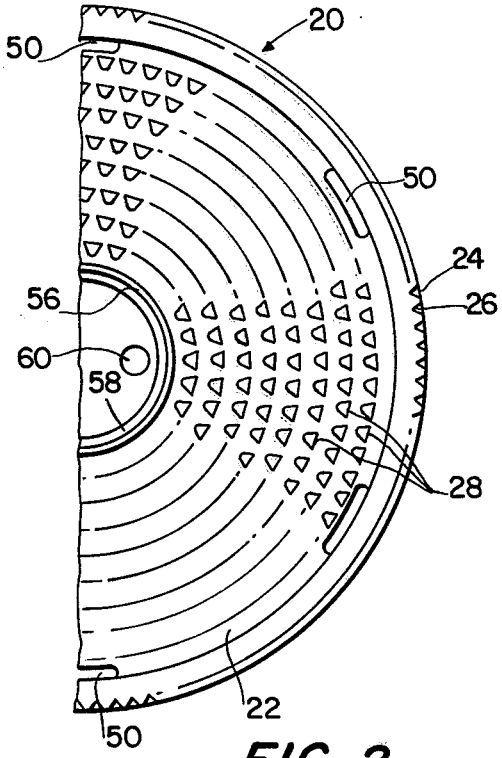
FIG. 2 is a top plan view of the inventive brush.
Figure 3:
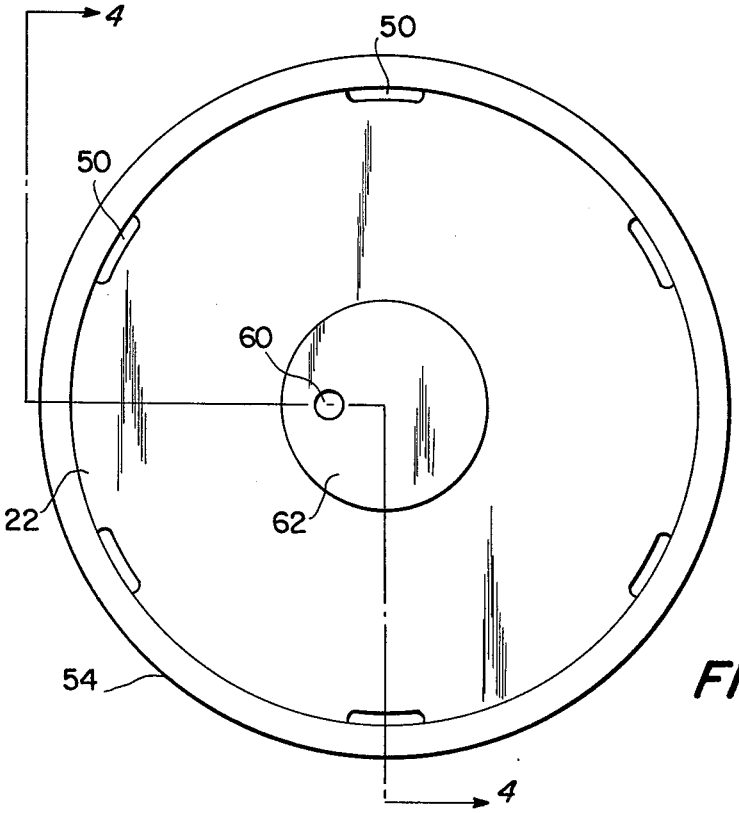
FIG. 3 is a bottom view of the inventive brush.

As seen in FIGS. 2 and 4, sidewall member 24 is preferably integrally formed with the base member and the bristles of the inventive brush. The sidewall is considerably thicker than the bristles and provides a rigidity for the brush when grasped. To avoid interfering in the brushing function, knurled sidewall member 24 is shorter than both the annular rows 32 of long bristles and 34 of short bristles.

Figure 5A:
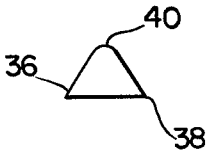
FIG. 5*a* is a top plan cross-sectional view of a bristle used in the present invention.
Figure 5B:
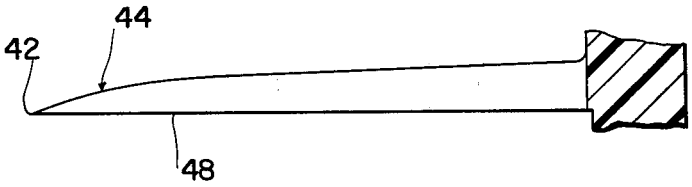
FIG. 5*b* is an enlarged elevation view of the bristle in FIG. 5*a*.

An individual bristle utilized in the present massaging brush is shown in FIGS. 5*a* and 5*b*. As shown in FIG. 5*a*, the bristle includes a substantially triangular shape, with sharp corners 36 and 38 at the base thereof, and a rounded apex 40. While apex 40 may be selected to have any reasonable radius of curvature, the presently preferred embodiment contemplates radii in the range 0.005 to 0.020 inches, and preferably a radius of curvature of $0.010 \pm 0.003$ inches. As will be seen from the subsequent discussion, corner 40 slides along the user's skin. Accordingly, a sharpened corner is desirable in order better to penetrate the ingrown hair loop. However, too sharp a corner in contact with skin might lead to undesirable results or irritation. The preferred value for the radius of curvature of corner 40 provides minimal irritation yet maximal hair removal from the false follicles generated by the pseudofolliculitis barbae condition.

A further advantage of the bristle utilized in the present invention is shown from FIG. 5*b*, wherein the profile view indicates a sharpened frontal protion 42 characterized by a second radius of curvature 44, 0.5 inches, for example. The bristle may also be tapered, as seen in the figure. The narrowed portion 42 permits the bristle to be applied to the skin at a minimized frontal elevation. That is, the bristle is capable of penetrating loops 12 shown in FIG. 1*b* which are extremely close to the skin surface. The bristle, ordinarily contacting the facial skin along its curved frontal portion, thus presents a ramp 46 shown in FIG. 1*b* and formed of the flat back portion 48 of the bristle. For shorter bristles, shown in rows 34, for example, the radius of curvature might itself be shortened in order to minimize blunting of the frontal point of these bristles which are stiffer and less flexible than the bristles of rows 32 and more frequently contact the user's skin in a perpendicular orientation.

Brush 20 is provided with a plurality of drain holes 50 distributed along the periphery thereof. While the drain holes may be otherwise distributed as well, the present invention advantageously minimizes interruption of the bristle pattern by the drain holes and provides drainage with the aid of the non-obtrusive peripheral drain holes 50. Referring to FIG. 4, base member 22 is seen to be inwardly dished. That is, the base is concave when viewed from the bottom of the brush. This concave feature assures that when the brush is resting on a stepped periphery 54 located at the bottom of base member 22 any drainage material will flow towards the peripheral segments, and particularly towards the sidewall 24, where the drainage will occur through drain holes 50.

Brush 20 is intended for use in preparation for shaving of an area afflicted by razor bumps. It is accordingly a further advantageous feature of the invention to provide a storage means therein for a razor. Specifically, a cup 56 is formed centrally within brush 20. The cup is integrally formed with the brush by the formation of an inner sidewall 58, concentric with sidewall 24 and with annular rows 32 and 34. The cup is thus useful for caddying a razor intended for use in conjunction with the present brush. A further drain hole 60 is provided within cup 56 to permit drainage of any drippage and fluid accumulation from the razor stored therein. While six peripheral drainage slots and a single central drainage slot are shown in the present embodiment, it is appreciated that other configurations may be utilized.

In storage, the brush rests on stepped periphery 54 thereof, as previously indicated. For enhanced stability, bottom portion 62 of cup 56 is vertically displaced from periphery 54. Specifically, the center cup bottom wall is located 0.015 inch higher than the bottom of sidewall 24 in order to assure that the brush, indeed, rests on its peripheral circular bottom step and does not wobble on cup 56, and further to assure clearance for drainage hole 60.

For ease in molding the present device, undercuts 64 and 66 are provided in peripheral step 54 and cup bottom 62, respectively.

In operation, the brush is held along sidewall 24, selected to be circular and knurled for ease in grasping. The bristles are applied to the face, preferably wet and soaped, with a comfortable pressure. The beard is scrubbed by the brush, preferably in an epicyclic motion in order to assure that the bristles attack the ingrown hairs in all directions. Upon application of pressure to the brush the individual bristle tip, which is least rigid in the radial direction, will tend to bend in that radial direction. The circular arrangement of the bristles shown in FIG. 1 accordingly provides for bristles to bend in all directions upon application of pressure to the brush. The bristles are thus presented in all attitudes to the surface being scrubbed, regardless of the scrubbing motion, though circular motion would appear to provide the greatest number of bristles to perform the function shown in FIG. 1*b*.

With a bristle tip bent in the radial direction, it may slip under the loop of an ingrown hair as shown in FIG. 1*b*, and pull the hair out. Where ingrown hairs are located within a channel in the skin, or virtually or wholly subcutaneously, the present brush advantageously provides shorter bristles, which remain stiff even after application of pressure to the brush, for scrubbing the skin and at least partially exposing some of the ingrown hair. Such scrubbing is further enhanced by the bristle geometry previously discussed with respect to FIG. 5*a*.

Upon application of additional pressure to the brush, additional, stiffer bristles will contact the skin. Accordingly, the present massage apparatus provides for a varying degree of scrubbing by the application of varying pressure. While scrubbing intensity may be varied in an ordinary brush by variation of the pressure applied, once a particular threshold level is reached and the bristles bend, substantially all of the bristles will bend inasmuch as all are of the same length and accordingly have the same stiffness characteristics. In brushes providing two levels of bristles, essentially two scrubbing intensities may be achieved. The present massage brush, however, provides for a much greater range of scrubbing intensity by providing a plurality of bristle heights, the differing heights of the bristles coming into contact with the skin upon excessive application of increasing pressure.

The preferred embodiment of the massage brush accordingly provides for four annular rows of bristles having a common vertical termination, approximately two-thirds of one inch above the bottom of stepped periphery 54. Other numbers of rows and other bristle heights may, of course, be used. The longest bristle tips are arranged in the four annular rows to contain 224 bristles, comprising 53% of the total number of bristles on the massage brush. In one model of the brush, the center row includes bristles which are 0.038 inches shorter than the long bristles and accordingly stiffer as well. The third row from the center includes bristles 0.055 inches shorter than the full-length bristles, the fifth row being 0.072 inches shorter and the seventh row being 0.090 inches shorter than the full-length bristles. In another model, the center row bristles are 0.017 inches shorter than the long bristles. The third, fifth and seventh rows are 0.025, 0.032 and 0.040 inches shorter than the long bristles, respectively. Thus, with increasing application of pressure an increased number of increasingly stiffer bristles will contact the skin. The alternating arrangement of the long and short rows of bristles is provided to assure the greatest possible area of long bristle contact within the envelope of bristles. The user is thus assured of massaging, or scrubbing, the greatest area for all brush pressures. For example, if the long bristles were all clustered in the four center annular rows the area of long bristle contact would be approximately one-half square inch. If all long bristles were concentrated in the outermost rows, the area of long bristle contact would be approximately 0.9 square inch. With the present arrangement, long bristle contact is provided over an area of approximately 1.4 square inches.

It is appreciated that other distributions of bristle sizes may be obtained, and that several bristle heights may be combined in a single annular row. Such an arrangement would allow the proportioning of different combinations of length of contacting bristles, and further permit maximization of area of coverage for all bristle sizes. The present arrangement, however, is selected for simplification of mold construction and maintenance in comparison to equipment for manufacturing a brush wherein each row of bristles contains a plurality of bristle lengths.

In the present arrangement it is recognized that increasing the applied pressure to permit contact of bristle row 34 increases the number of contacting bristles by 7.1% of the total number of bristles on the brush. Increased pressure to provide contact for row 34*a* provides an additional 10.6% increase in number of contacting bristles. Further increase of pressure to provide contact for bristle row 34*b* yields a further increase of 12.7% in the number of contacting bristles, while a further pressure increase to allow contact of row 34*c* with the skin yields a 16.7% increase in the number of contacting bristles. Clearly an arrangement wherein row 34 is the outermost and row 34*c* is the innermost row of bristles would change the data given above and would indicate that on the first increment of pressure an additional 16.7% of the number of bristles would contact the skin, while on the last step of increased pressure only 7.1% increase in the number of contacting bristles would be obtained.

The preceding specification describes, by way of illustration and not of limitation, a preferred embodiment of the invention. Equivalent variations of the described embodiment will occur to those skilled in the art. Such variations, modifications, and equivalents are within the scope of the invention as recited with greater particularity in the following claims, when interpreted to obtain the benefits of all equivalents to which the invention is fairly entitled.

What we claim is:

1. Facial scrubbing brush for removing ingrown hairs from false follicles, comprising:

a base portion;

peripheral side support means connected to said base portion; and a plurality of elongated discrete, resilient members connected to said base portion and disposed perpendicular thereto, including first members of a uniform height, each discrete first member being arranged exclusively in first concentric annular rows on said base portion such that said first concentric annular rows exclusively comprise said first members, and second members having a plurality of heights shorter than said uniform height, each discrete second member being arranged exclusively in second concentric annular rows on said base portion such that said second concentric annular rows exclusively comprise said second members, said first annular rows being separate and distinct from said second annular rows and at least one of said first annular rows being interspaced between a pair of said second annular rows, each of said discrete first members being sufficiently resilient and having a cross-sectional dimension sized to curl beneath and into loops of ingrown facial hair, and each of said discrete second members cooperating with said first members to dislodge said ingrown hairs as the brush is moved along the face, wherein said base portion is concave in a direction opposite to said elongated members and includes a plurality of first drainage means distributed about the periphery thereof.

2. Facial scrubbing brush as recited in claim 1 wherein said peripheral side support means is generally knurled.

3. Facial scrubbing brush as recited in claim 1 wherein said peripheral side support means comprises means extending to a first predetermined distance beyond said base portion, in a direction opposite to said elongated members.

4. Facial scrubbing brush as recited in claim 1 further comprising means for storing a razor in said base portion.

5. Facial scrubbing brush as recited in claim 4 wherein said means for storing comprises means extending to a second predetermined distance beyond said base portion in a direction opposite to said elongated members, said second predetermined distance being smaller than said first predetermined distance.

6. Facial scrubbing brush as recited in claim 1 wherein said elongated members are sized and configured to engage loops of ingrown hairs in a plurality of directions.

7. Facial scrubbing brush as recited in claim 6 wherein said elongated members comprise sharpened terminal portions.

8. Facial scrubbing brush as recited in claim 7 wherein said first elongated members terminal portions are sharpened at a first radius curvature and said second elongated members terminal portions are sharpened at a second radius of curvature, said first radius of curvature being greater than said second radius of curvature.

9. Facial scrubbing brush as recited in claim 1 wherein said first members are arranged in alternate annular rows, said second members being in the alternative annular rows.

10. Facial scrubbing brush as recited in claim 1 wherein said base includes means for storing a razor and said storage means comprises second drainage means therein.

* * * * *